United States Patent [19]

Schap

[11] Patent Number: 4,916,861

[45] Date of Patent: Apr. 17, 1990

[54] VARIABLE POWER DRIVE FOR SLIDING DOOR

[75] Inventor: William W. Schap, Jackson, Mich.

[73] Assignee: ITT Corporation, New York, N.Y.

[21] Appl. No.: 318,564

[22] Filed: Mar. 3, 1989

[51] Int. Cl.[4] ..... E05F 15/20

[52] U.S. Cl. ..... 49/31; 49/360; 296/155

[58] Field of Search ..... 49/360, 361, 362, 31; 296/155

[56] References Cited

U.S. PATENT DOCUMENTS 3,462,883 8/1969 Reeks et al. ..... 49/360
4,640,050 2/1987 Yamagishi et al. ..... 49/360 X
4,738,052 4/1988 Yoshida ..... 49/360 X
4,794,731 1/1989 Willmott et al. ..... 49/360 X

*Primary Examiner*—Philip C. Kannan
*Attorney, Agent, or Firm*—Robert P. Seitter

[57] ABSTRACT

A power drive system for opening and closing the sliding side door of a van type vehicle includes an inclination detector controlled control circuit for adjustably regulating the closing force applied to the door in approximate proportion to the inclination of the vehicle to provide sufficient power to close the door when the vehicle is parked on an uphill grade while providing a reduced amount of power to close the door when the vehicle is on level ground.

6 Claims, 1 Drawing Sheet

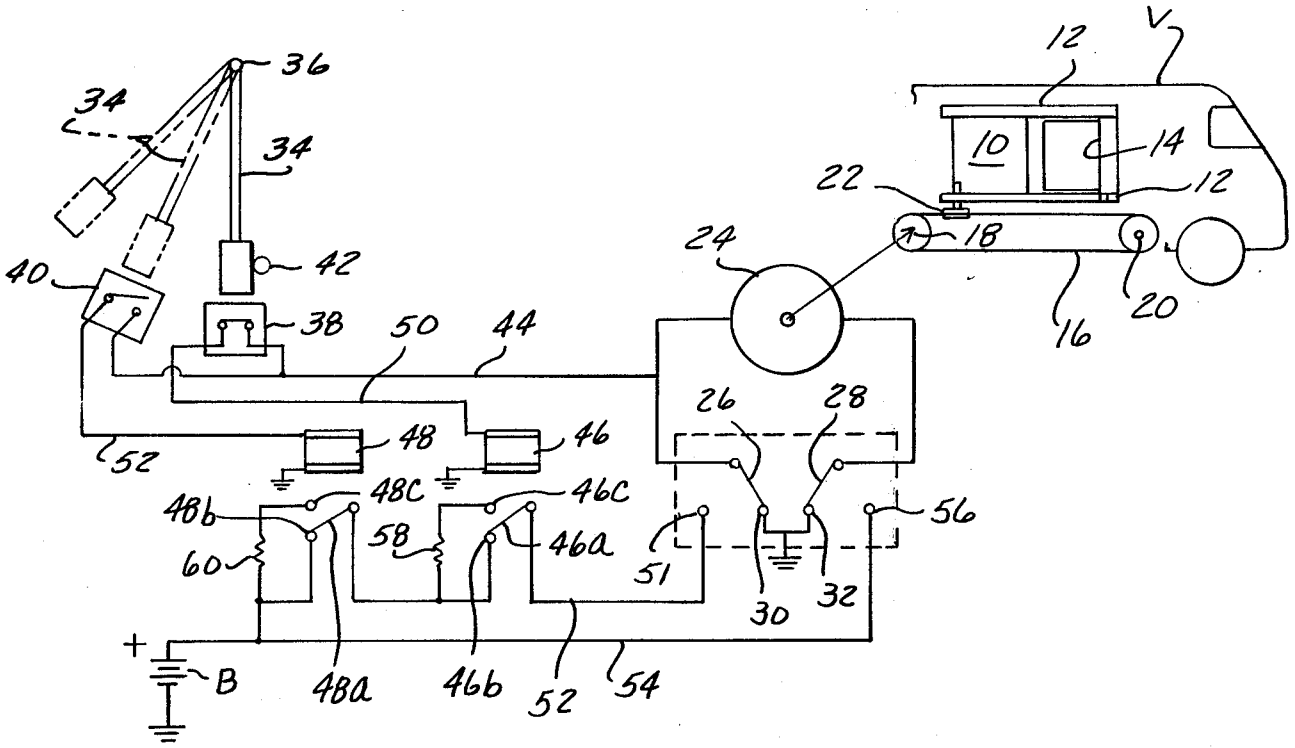
V
12
14
12
10
16
20
18
22
24
56
28
32
30
26
51
54
52
46
46c
46a
46b
44
50
48
48c
58
48a
42
38
36
34
34
40
52
48b
60
B
+

VARIABLE POWER DRIVE FOR SLIDING DOOR

BACKGROUND OF THE INVENTION

The present invention is directed to a variable power drive employed to drive a sliding side door of a vehicle between its open and closed position.

Power drive systems for opening and closing the sliding doors of vehicles conventionally employ a reversible drive motor coupled to the door through appropriate mechanism to drive the door between its open and closed position. The sliding door is mounted upon the vehicle for forward and rearward movement and is supported for this movement upon tracks which define a horizontal path when the vehicle is parked on level ground. The door is supported upon the tracks by rollers and thus there is very little resistance to movement of the door when the vehicle is level. However, the motor must be capable of supplying sufficient power to drive the door in closing movement if the vehicle is parked facing up hill. This presents a safety problem because a drive motor which has sufficient power to drive the door to a closed position when the vehicle is facing up hill will apply an excess amount of power to the door when the door is closed with the vehicle on level ground. This excess closing force is sufficient to cause injury if, for example, a child's arm is trapped between the closing door and door frame.

The present invention is directed to a variable power drive system for a sliding door which is automatically regulated to apply the minimum amount of closing force necessary when the vehicle is on level ground and to enable the application of an increased closing force sufficient to close the door when the vehicle is parked facing up an incline.

SUMMARY OF THE INVENTION

In accordance with the present invention, the control circuit for supplying power to a reversible motor which powers the door opening and closing system includes an inclination detector in the form of a pendulum mounted for pivotal movement about a horizontal axis normal to the longitudinal centerline of the vehicle. A first proximity switch is located to be closed by the pendulum when the pendulum is in the position it assumes when the vehicle is on level ground. Closure of this first poximity switch connects a voltage dropping registor in series with the DC motor to reduce the power supplied to the motor. One or more other similar proximity switches are located along the path of movement of the pendulum to be actuated at successfully increased steps of rearward and downward inclination of the vehicle, the switches being so spaced that one and only one switch will be actuated by the pendulum. Each of the switches includes a voltage dropping resistor of progressively decreasing resistance. When none of the proximity switches are actuated, the circuit connects the DC motor to receive full battery voltage to drive at maximum power.

Other objects and features of the invention will become apparent by reference to the following specification into the drawings.

IN THE DRAWINGS

The single FIG. of the drawings shows a schematic diagram of an exemplary form of electric circuit embodying the present invention, combined with a schematic showing of certain mechanically elements of the sliding door.

In the drawing, there is schematically shown a sliding door 10 mounted on tracks 12 for movement between an open position in which the door is located rearwardly of a door opening 14 in the side of a van type vehicle partially indicated at V. An endless cable 16 is operatively trained around a pair of end pulleys 18, 20 mounted for rotation about fixed axes on the frame of vehicle V and one run of the cable is attached to door 10 as by a coupling 22 fixedly secured to the cable. A reversible DC motor 24 is connected to drive pulley 18 in rotation to drive cable 16 in door opening and closing movement.

The opposite sides of motor 24 are electrically connected respectively to a door closing switch 26 and a door opening switch 28 which, in the drawing, are shown in their unactuated position in which both sides of the motor are connected to electrical ground via ground contacts 30, 32.

To detect the inclination of the van, a pendulum 34 is mounted in the vehicle at an appropriate location for pivotal movement about a fixed horizontal axis 36 which extends perpendicular to the longitudinal centerline of the vehicle. Two or more proximity switches 38, 40 are mounted at fixed locations within the vehicle along the path of pendulum 34. In the specific embodiment illustrated in the drawing, two proximity switches 38 and 40 are employed, the switch 38 being located in a position to be actuated by the pendulum when the vehicle is level, and the second switch 40 being located to be actuated when the vehicle is on an upward incline. Switches 38 and 40 are normally open and are operable to close when the pendulum is within an actuating proximity of the switch. The spacing between switches 38 and 40 is such that when the pendulum moves out of actuating proximity to switch 38, it simultaneously moves into proximity with switch 40. A stop 42 will retain pendulum 44 in actuating proximity to switch 38 if the vehicle is inclined downhill. As shown, the contacts of switch 38 are closed, while those of switch 40 are open. One contact of each of switches 38 and 40 is electrically connected by a lead 44 into the circuit of motor 24 while the other side of switches 38 and 40 are respectably connected to relays 46, 48 by leads 50, 52.

Each of relays 46, 48 includes a movable contact **46*a*, 48*a* respectively which, in the drawings, is shown in a normal position which the contact assumes when its associated relay is not energized. When the contacts 46*a*, 48*a*, are in the position shown in the drawing, the positive terminal of the vehicle battery B is electrically connected to the normally opened contact 51 of door close switch 26 via contact 48*b*, switch 48*a*, contact 46*b* switch 46*a* and lead 52. A second electrical lead 54 connects the positive terminal of battery B to the door opening contact 56 of door opening switch 28. The normally opened relay contacts 46*c*, 48*c* are electrically connected via resistors 58, 60 to the associated switch contacts 46*b*, 48*b***.

Operation of the circuit is as follows:

If, as shown in the drawings, the sliding door 10 of vehicle V is in its open position and the vehicle is on level ground, the various switches of the circuit will be in the position shown in the drawing. To close the door, the door closing switch is manually shifted and held in contact with the door closing contact 51. The closure of switch 26 with contact 51 completes an electrical circuit through both motor 24 and relay coil 46. Initially, a positive terminal of battery B is electrically connected to contact 51 via lead 52 and switches 46*a*, 48*a*. From contact 51, the circuit proceeds through switch 26 to one side of the motor, and from the other side of motor 24 to ground via the door open switch 28 and contact 32. From switch 26, the circuit also proceeds through lead 44, the contacts of proximity switch 38, which are closed at this time because the vehicle is in a level position, and hence through lead 50 to relay coil 46. Upon energization of relay coil 46, the contact 46*a* immediately shifts from contact 46*b* to contact 46*c*, thus electrically connecting resistor 58 in series between battery B and motor 24. Resistor 58 functions as a voltage dropping resistor, and thus a reduced voltage is supplied to motor 24 to cause the motor to drive at a relatively low power sufficient to drive door 10 in closing movement.

Upon full closure of the door (or partial closure if desired), the door close switch 26 is released to return to its original position in engagement with contact 30, thus deenergizing motor 24 and relay 46.

To reopen the door, the door opening switch 28 is actuated and held in contact with fix contact 56. This connects battery B to one side of the motor via lead 54, contact 56, switch 28 and hence through the motor to switch 26 to ground via contact 30. Opening of the door is entirely independent of the circuitry controlled by the pendulum actuated proximity switches 38, 40, and opening of the door is always, in the embodiment disclosed, accomplished by full power of motor 24.

If it is assumed the vehicle is parked facing uphill at an inclination such that pendulum 34 is within actuating proximity of switch 40, actuation of door closing switch 26 to close with contact 51 is as previously described, with the exception that now the contacts of proximity switch 38 are open, and those of proximity switch 40 are closed. Closure of the contacts of switch 40 and actuation of the door closing switch 26 causes an energization of relay coil 48 which shifts its associated switch 48*a* to contact 48*c*, thus connecting resistor 60 in series between the battery B and motor 24. At this time, relay coil 46 is deenergized, and the positive terminal of battery B is connected to the door closing contact 51 via resistor 60, contact 48*c*, switch 48*a*, contact 46*b* and switch 46*a* to lead 52 and hence to contact 51.

Resistor 60 acts as a voltage dropping resistor so that motor 24 will drive at less than its full power. The resistance of resistor 60 is less than that of resistor 58 so that the motor drives with less than full power to close the door when the vehicle is on a moderate incline, but more power than was applied to close the door when the vehicle was on level ground.

If the vehicle is parked on a steep incline with the door open, pendulum 34 will swing well beyond proximity switch 40 and out of actuating proximity with that switch. In this situation, upon the actuation of door closing switch 26 end of contact with the door closing contact 51, the motor will drive at full power in that both proximity switches 38 and 40 are opened, and with both relays 46 and 48 deenergized, the switches 46*a*, 48*a* are connected as shown in the drawings to provide a direct connection between battery B and contact 51.

While one embodiment of the invention has been described in detail, it will be apparent to those skilled in the art the disclosed embodiment may be modified. Therefore, the foregoing description is to be considered exemplary rather than limiting and the true scope of the invention is that defined in the following claims:

I claim:

1. In a power drive system for a sliding door mounted on a side of a vehicle for sliding movement forwardly and rearwardly of the vehicle between an open and a closed position, said system including reversible power drive means operable when actuated to selectively drive said door in opening or closing movement;

the improvement comprising inclination detecting means for detecting the front to rear inclination of the vehicle, and control means including regulating means operable by said detecting means for regulating the power applied by said drive means to move said door toward its closed position in approximate proportion to the degree of inclination detected by said detecting means.

2. The invention defined in claim 1 wherein said detecting means comprises a pendulum suspended for pivotal movement about a horizontal axis normal to the longitudinal centerline of the vehicle, and a plurality of sensing means mounted at fixed locations spaced along the path of movement of said pendulum for sensing the angular position of said pendulum.

3. The invention defined in claim 2 wherein said power drive means comprises reversible drive motor means, a power source having a substantially constant power output for supplying power to drive said motor means, and said control means further comprises directional control means for connecting said motor means to said source to selectively drive said door in opening or closing movement, said directional control means including first means for bypassing said regulating means and connecting said motor means directly to said power source to receive the full power output of said source when said motor means is connected to drive said door in opening movement, said second means for connecting said motor means to said source to be controlled by said regulating means when motor means is connected to drive said door in closing movement.

4. The invention defined in claim 3 wherein said detecting means operates said regulating means to regulate the power applied by said drive means to close said door to a minimum amount of power when said vehicle is in a level position or a forwardly and downwardly inclined position and to increase the power applied by said drive means to close said door in approximate proportion to the magnitude of a rearward and downward inclination of said vehicle.

5. The invention defined in claim 4 wherein said motor means is a reversible DC motor, said source is an electric battery, and said regulating means includes a plurality of voltage dropping resistors of differing electrical resistance respectively connected to each of said sensing means, each of said sensing means comprising a proximity switch operable when said pendulum is within an actuating proximity to the switch to connect the resistor connected thereto in series between said battery and motor.

6. The invention defined in claim 5 wherein a first of said proximity switches is located in a position to be closed by said pendulum when the vehicle is level, and second of said switches is located in a position to be closed by said pendulum when the vehicle is inclined at a downward and rearward inclination, the resistance of the resistor connected to said first of said switches being greater than the resistor connected to said second of said switches.

* * * * *